US005237786A

United States Patent [19]

Kochansky

[11] Patent Number: 5,237,786

[45] Date of Patent: Aug. 24, 1993

[54] INTERIOR WALL SYSTEM

[76] Inventor: Katharine M. Kochansky, 111 Thibodeaux, Lafayette, La. 70503

[21] Appl. No.: 809,425

[22] Filed: Dec. 17, 1991

[51] Int. Cl.[5] ..... E04B 2/82

[52] U.S. Cl. ..... 52/126.4; 52/242

[58] Field of Search ..... 52/239, 238.1, 241, 52/242, 243, 243.1, 126.1, 126.4

[56] References Cited

U.S. PATENT DOCUMENTS 3,341,992 9/1967 Piper .
3,722,157 3/1973 Prokop .
4,103,463 8/1978 Dixon ..... 52/126.4
4,662,131 5/1987 Glockenstein .
4,680,902 7/1987 Stefnik et al. ..... 52/126.4
4,881,352 11/1989 Glockenstein .

*Primary Examiner*—Carl D. Friedman
*Assistant Examiner*—Creighton Smith
*Attorney, Agent, or Firm*—William W. Stagg

[57] ABSTRACT

A temporary interior wall panel system may be mounted between the ceiling and the floor areas of a building to provide for interior partitioning of building space. The wall panel system includes easily mountable and demountable floor tracks, wall panels, and columns. The wall panels and columns are held in place between the building ceiling area and floor area by screwably adjustable jacks having ceiling and floor bearing plates. The position of the jacks along the length of the wall panels is adjustable.

11 Claims, 11 Drawing Sheets

INTERIOR WALL SYSTEM

FIELD OF INVENTION

The present invention relates generally to interior wall partitions and, more particularly, is concerned with an interior wall system which can be installed and removed easily, without extensive labor or alteration of the building.

BACKGROUND OF INVENTION

Building interior walls on site is impractical and expensive and requires skilled labor, custom sized materials, and increased construction time. These factors increase the overall costs of building construction and renovation.

Attempts at providing prefabricated interior walls are known. A wall of this type is described and illustrated in U.S. Pat. No. 3,341,992 to B. W. Piper. The interior wall of Piper is provided with a header at the upper end of the panel which is activated vertically by means of a crank and key provided on one face of the panel. The header is provided with a resilient pad at its upper edge for engaging the ceiling of the room in which the panel is to be installed. There are certain disadvantages implicit in the Piper wall. First the ceiling must be of sufficient structural strength to support the pressure from the header. It would not be sufficiently adaptable to partition rooms with suspended ceilings. Second, the wall panel is operated by means of a removable crank which fits into a key and thus requires a special tool for assembly and disassembly.

Other partition walls have been suggested. U.S. Pat. No. 4,881,352 to K. Glockenstein also discloses a prefabricated wall panel. At the upper edge of the panel is a U-shaped channel capable of receiving the web or shank of another U-shaped channel which has been mounted to the ceiling of the interior area to be walled off. Fitting one U-shape section into the other serves the purpose of securing the wall panel to the building ceiling. The height of the wall panel is adjusted by set screw means at the base of the wall panel. Disadvantages associated with U.S. Pat. No. 4,881,352 by Glockenstein is that there must be a U-shaped receiving channel secured by screws or other means to the ceiling of the building to accept the wall panel. This reduces the flexibility of wall use because, again, use of the partition would be hampered in areas where suspended ceiling are involved or in areas where there is no way to secure the receiving channel to the ceiling without extensive ceiling reframing. This requires additional labor and material costs. Installation of the U-shaped receiving channel also require some permanent or semipermanent installation limiting the versatility of the removable wall.

U.S. Pat. No. 4,662,131 also by K. Glockenstein discloses an interior wall element having cover plates for which adjustments to the height and width of the panel can be made by virtue of recessing the uprights and cross-bars of the element backwards from the edges of the cover-plates. The recesses are filled with filler pieces which are removable. A leveling device is provided with adjusting screws to compensate for unevenness of the floor. The Glockenstein U.S. Pat. No. 4,662,131 does not provide a means for temporarily mounting and supporting the wall panel within the interior space to be partitioned.

U.S. Pat. No. 3,722,157 to V. Prokop disclosed a prefabricated wall panel having a U-shaped outer vertical web slotted to receive hook projections from an adjacent mounting bracket. To utilize Prokop the mounting bracket must be secured either vertically or horizontally to the ceiling or walls. This does not facilitate either temporary installation or ease of assembly.

Consequently a need exists for improvements in prefabricated interior walls of this general type which will result in greater ease of installing and removing the walls and that provides more flexibility of use of temporary wall panels for the user.

SUMMARY OF INVENTION

The present invention provides an interior wall partition system designed to satisfy the aforementioned needs. The invention embodies a unique compression jacking or mounting mechanism for wall panels and columns that is simple, efficient and requires very little labor to install. Furthermore, the wall is easily demountable and thus provides increased versatility over the previous interior wall devices.

Accordingly, the present invention relates to prefabricated interior wall panels and columns for partitioning interior spaces in commercial and other type buildings which, includes a frame composed of horizontal and vertical members, sheathing overlaying the frame, and having a horizontally and vertically adjustable compression mounting mechanism at the top and bottom of the wall panels and columns. It is the unique compression mounting mechanism which is adjustable both horizontally and vertically to secure the wall panels and columns between the floor and the ceiling or the ceiling joists or beams that distinguishes this invention.

DESCRIPTION OF THE PREFERRED EMBODIMENTS

Figure 1:
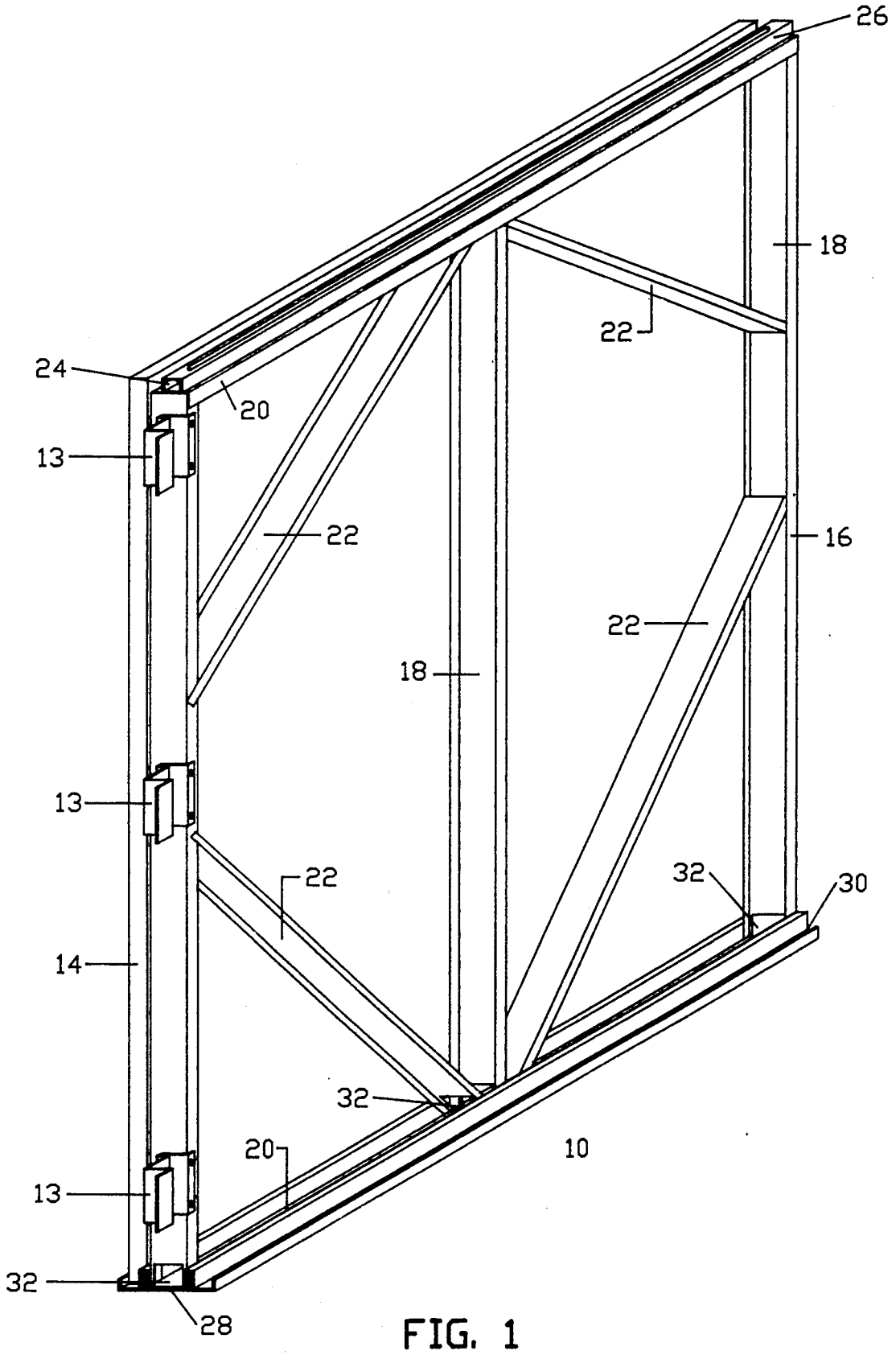
FIG. 1 is an axonometric view of the wall panel 10.

Referring now to the drawings and more particularly to FIG. 1, there is shown generally the preferred embodiment of the improved interior wall panel designated 10. The typical wall panel 10 as illustrated includes wall sheathing 14 applied over a metal frame 16 comprised of C-shaped vertical members 18 and U-shaped horizontal framing members 20 with diagonal bracing 22 as required. Members of other shapes could also be utilized to form the frame 16. Sheathing 14 is shown only on one face of the panel 10 in order to illustrate the frame 16. In use sheathing 14 is applied over both sides of the frame 16.

Figure 2:
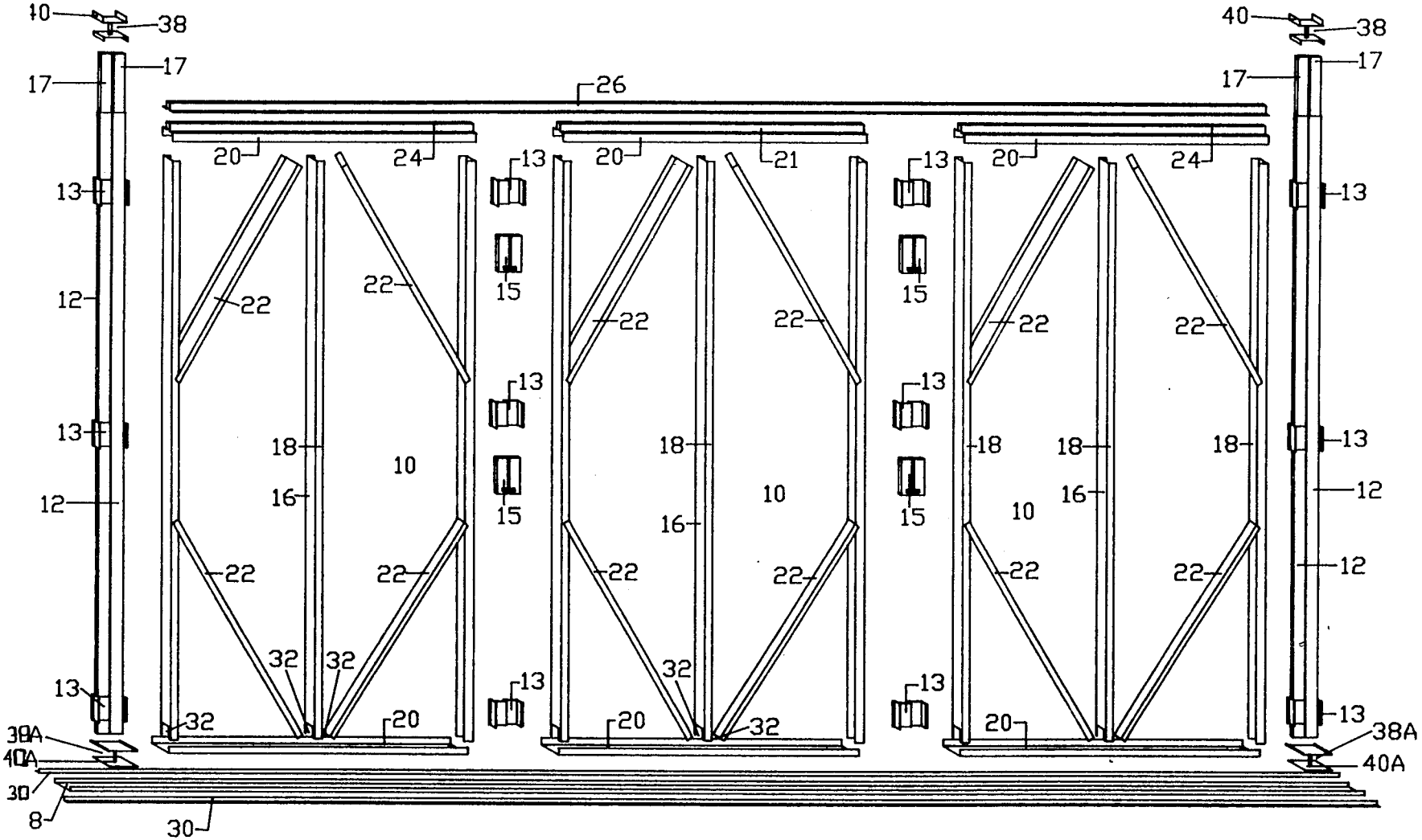
FIG. 2 is a perspective view of a series of disassembled wall panels 10.

FIG. 2 is a perspective view of a series of disassembled wall panels 10 showing the various components making up the wall system. The panels 10 are shown positioned between a groups of extended removable columns 12 which serve to support the panels 10. The columns 12 are connected to the panels 10 by a plurality of column retainers 13 attached along the end edges of the panel frames 16. The extended columns 12 may be located as desired in areas where support for the partitioning is required or where wall panel termination is desired and where rafter or roof beams or other ceiling area support is found. In areas where columns are not required or desirable, adjoining panels 10 are connected by a plurality of column stubs 15 fitted between the column retainers 13 for lateral support between individual panels 10. The sheathing 14 is not shown in FIG. 2 for clarity of illustration.

At the ceiling edge of each panel 10 is a ceiling assembly comprising a compression channel 24 and a hat-shaped top locking plate 26. Along the floor edge 23 of each panel 10 is a C-shaped floor track 28 sized to accommodate the thickness of the bottom C-shaped horizontal member 20. The bottom horizontal member 20 of the frame 16 of each panel 10 is fitted into the floor track 28. The floor tracks 28 are equipped with sheathing clips 30 at each side of the wall panel to receive the wall sheathing 14. The vertical members 18 and the diagonal bracing members 22 have slots 32 to create a raceway for electrical conduit or other utilities along the floor track 28.

Figure 3:
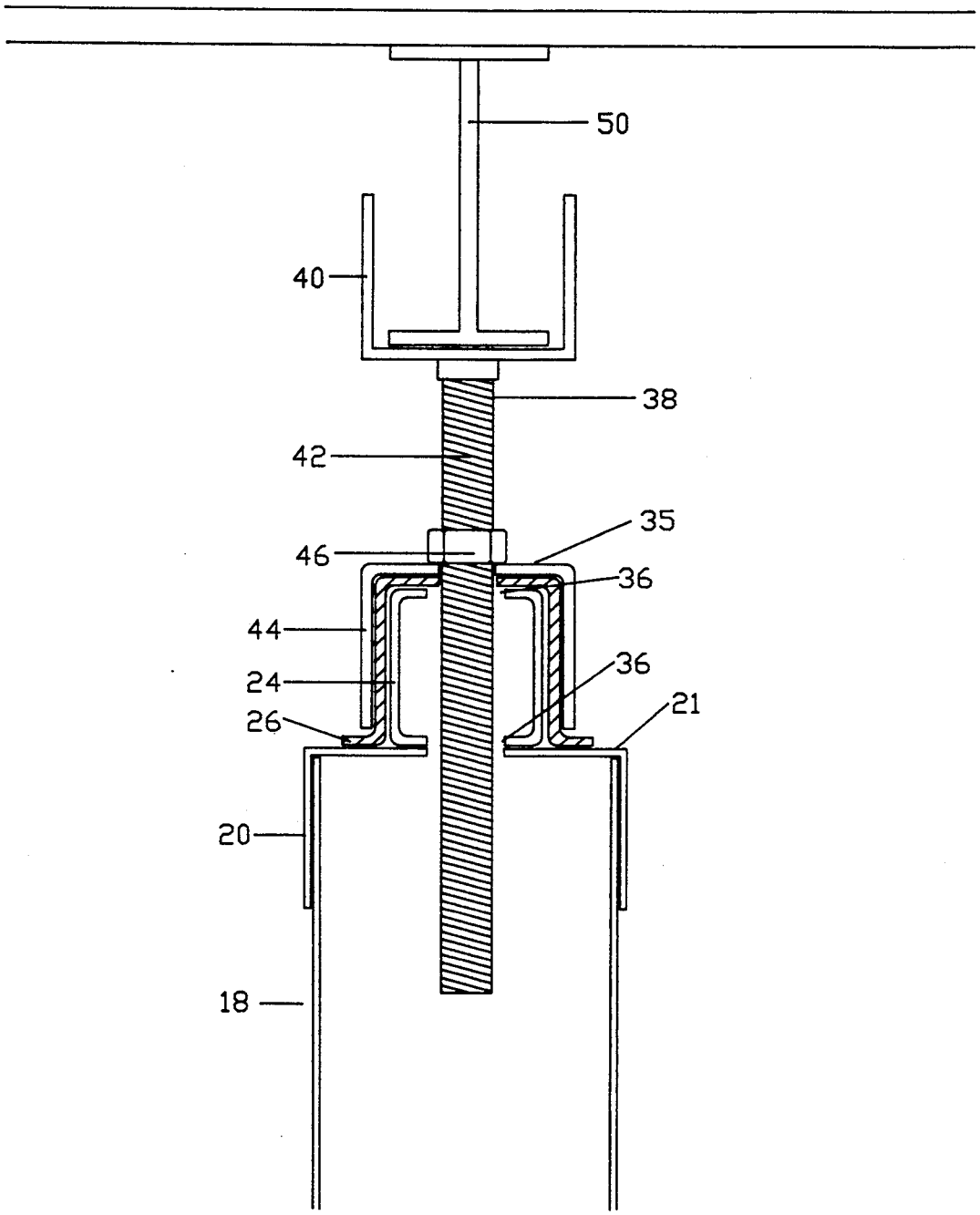
FIG. 3 is a cross-sectional view of the ceiling edge of the wall panel 10.

FIG. 3 is a partial cross-section of the frame 16 at the ceiling edge 21 showing the ceiling compression assembly 35. It is the compression assembly 35 along with the mounting or jacking mechanism 38 that holds the wall panel in position and allows for ready take down and repositioning of the wall when required by the user. The compression assembly 35 is comprised of a compression channel 24 and a hat-shaped top locking plate 26 located over the top horizontal member 20 of the panel frame 16. The compression channel 24, the hat-shaped top locking plate 26 and the horizontal members 20 have longitudinal slots along the web of each element to create a slot space 36 in each. This slot space 36 in each element may be utilized to provide room within the frame 16 for electrical wiring and other utility conduit which may be pre-installed or installed on site, but more importantly the slot space 36 serves as a guide for a plurality of jacking mechanisms 38. Each jacking mechanism 38 is slidably mounted to the frame 16 along the slot space 36 for lateral movement of each jacking mechanism 38 along the wall frame 16 and consequently along the wall panel 10. This lateral sliding feature allows each jacking mechanism 38 to be positioned at any desired point along the wall frame to engage a fixed point such as a ceiling joist or beam that will insure stability.

Each jacking mechanism 38 is comprised of a saddle 40, a threaded rod 42 mounted to the saddle 40, a U-shaped lock cap washer 44 and a lock nut 46. The U-shaped lock cap washer 44 is fitted onto the rod 42 and held in position by turning and tightening the lock nut 46 so that the U-shaped lock cap washer 44 slides vertically along the shaft of the threaded rod 42. Each jacking mechanism 38 is engaged between the top horizontal channel member 20, the compression channel 24 and the locking plate 26 by insertion of the threaded rod 42 through each slot space 36.

The jacking mechanism 38 is designed so that the saddle 40 moves vertically with respect to the wall panel 10 by means of turning the lock nut 46. This vertical movement allows the saddle 40 to be fitted against some fixed point such as the floor, the ceiling, a joist, or a beam all generally designated 50 in FIG. 3. Once fitted against some fixed point 50 the saddle 40 is locked in that position by turning the lock nut 46 with a wrench or other means in the opposite direction against the lock cap washer 44. By this turning the lock nut 46 is tightened against the lock cap washer 44 which is pressed against the locking plate 26 fixing the locking plate 26 against the compression channel 24. Tightening the lock nut 46 produces tension and compression forces which anchor the wall panel 10 in place. The slotted horizontal members 20, the slotted compression channel 24 and the slotted top locking plate 26 are sized to withstand the applied compression forces from the jacking mechanism 35 without deformation.

A floor jacking mechanism 38A similar in operation to the jacking mechanism 38 is shown and is used for supporting the column 12. Floor jacking mechanism 38A may also be located at desirable points along the floor track 28 by means of slots 36 along the length of the bottom horizontal member 20. The jacking mechanism 38A is locked in place in a manner similar to that of the jacking mechanism 38 to hold the wall in place. The floor jacking mechanism 38A is fitted with a sole plate 40A rather than a saddle 40 for support against a flat floor surface.

The column 12 shown in FIG. 2 may be lengthened or telescoped by the addition of extension members 17 to accommodate unusual ceiling heights. If extension members 17 are required, they are fitted with the jacking mechanism 38 at their terminal ends.

When installing a wall panel, the floor tracks 28 are placed in position along the line of the desired wall location. The lower sheathing clips 30 are then attached to the floor track 28. Wall panel frames 16 are moved into place along the floor tracks 28 and joined together by column stubs 15 and column retainers 13. Columns 12 are inserted as required. The ceiling compression assembly is positioned and Jacking mechanisms 38 are attached and positioned as required and are secured by turning the lock nut 46. Wall sheathing 14 is then fitted into the sheathing clips 30 and secured to the wall frame 16 at the top in a conventional manner to complete the wall panel 10. Because the sheathing is positioned as a last step the entire wall need not be disassembled in order to change wiring or utility lines, or to change panels at random.

The jacking mechanism 38 and 38A may be used to bear against beams, fixed ceilings, joists or floors as indicated by the circumstances of the area and building where walls are required. Rubber, plastic or other protective materials may be applied over the parts of the jacking mechanisms that come into contact with existing building surfaces to prevent marking or distress to those surfaces.

Each wall panel 10 can be independent and self-standing or installed as one of a series of wall panels. The jacking mechanism 38A, when used at the floor edge 23 of the panel frame 16, may also be used to level the wall panel 10 in areas where the floor is uneven. The column stubs 15 act to hold adjoining panels together while permitting vertical movement of the panels with respect to the floor to accommodate uneven floor areas.

Figure 4:
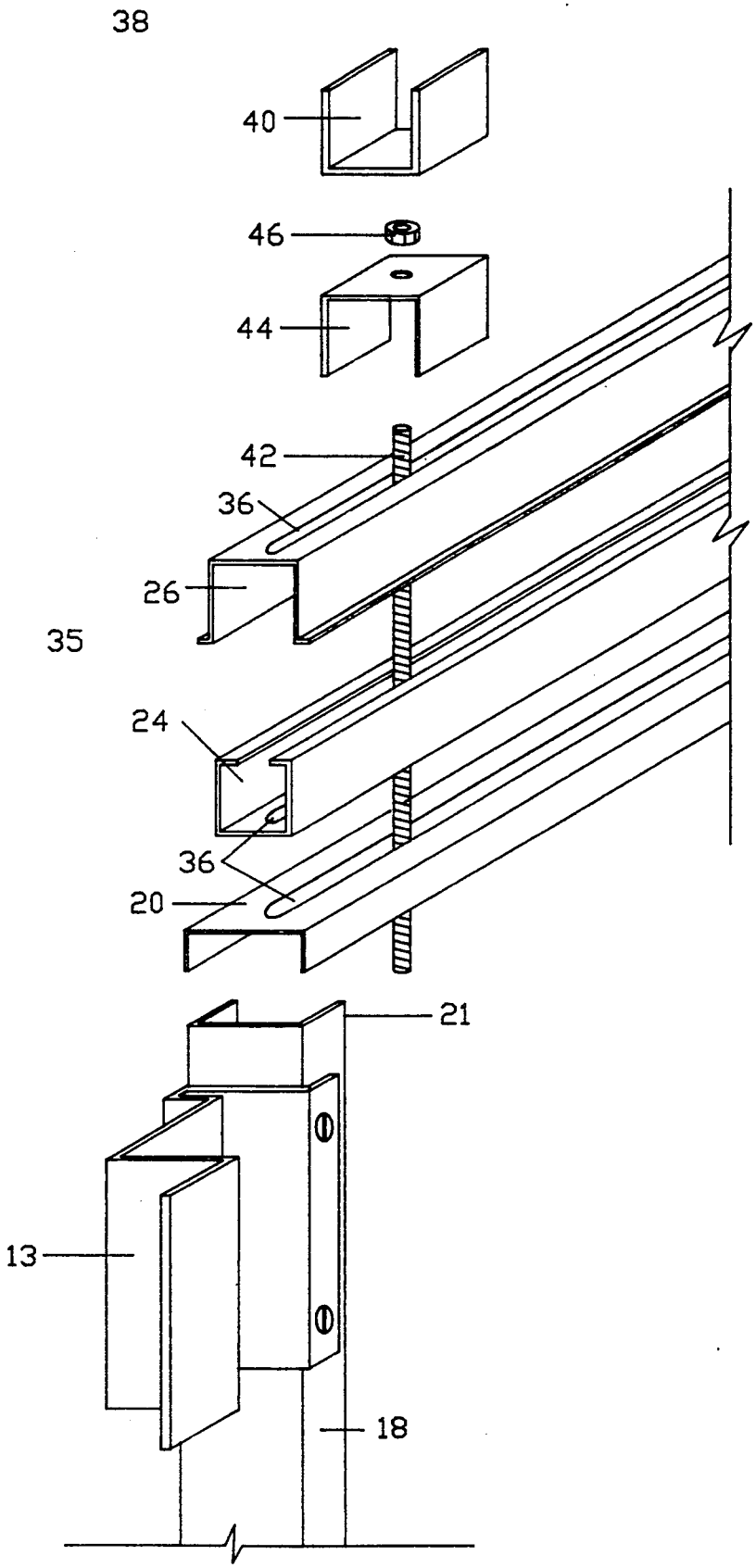
FIG. 4 is a disassembled view of the compression assembly 35 and the mounting mechanism 38.

FIG. 4 is a disassembled view of the ceiling edge 21 of the wall frame 16 showing the showing the components of the compression assembly of the jacking mechanism 38. The thread rod 42 of the jacking mechanism 38 is shown inserted through the slots 36 for lateral movement along the wall frame 16. In use the threaded rod 42 is connected to the saddle 40 by welding or other means.

Figure 5:
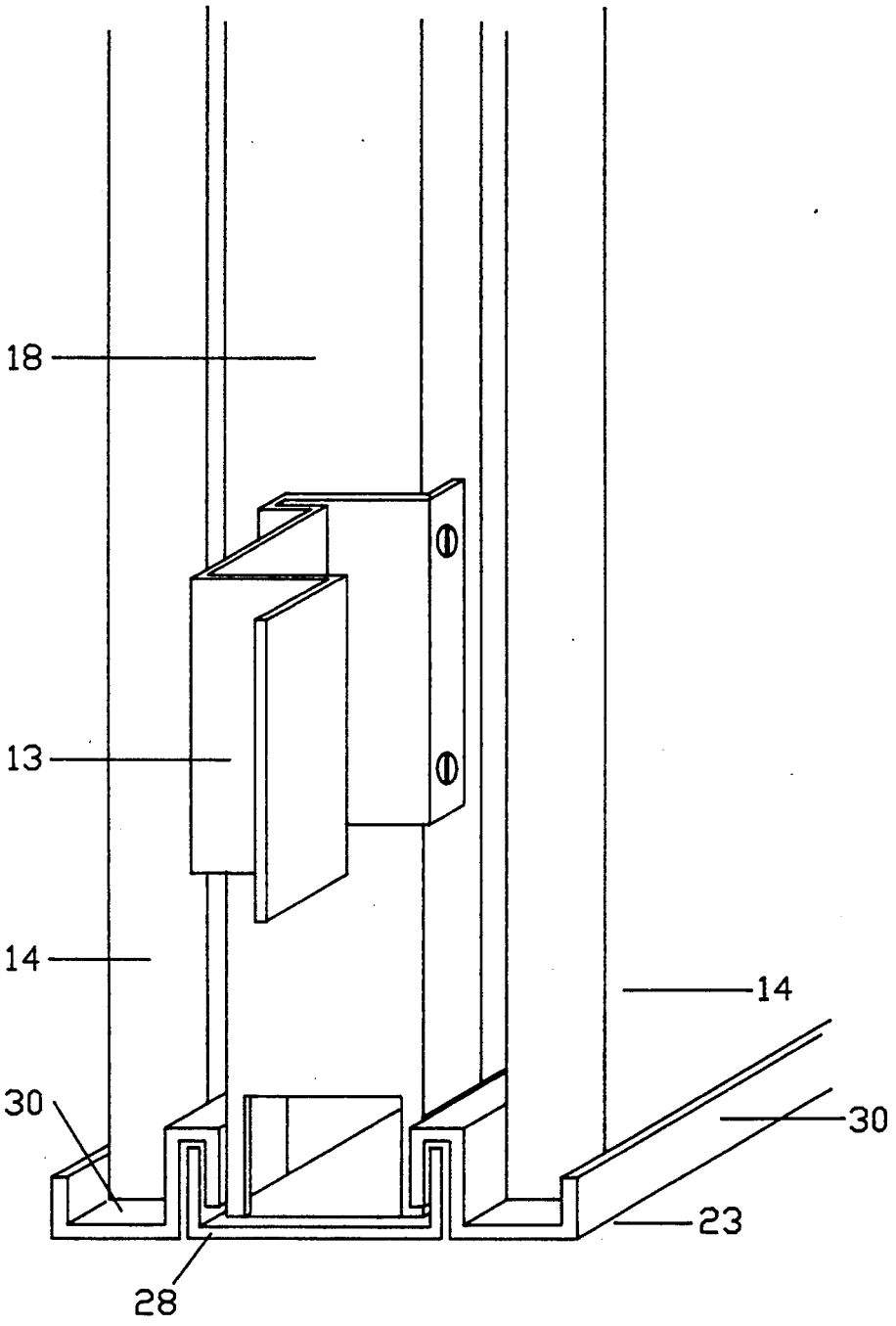
FIG. 5 is a partial axonometric view of the floor edge of the wall panel 10.

FIG. 5 shows the lower sheathing clips 30 fitted onto the floor track 28. The sheathing 14 is placed into the clips 30 and is tilted up into place over the frame 16 and secured at the top edge of the wall panel 10.

Figure 6:
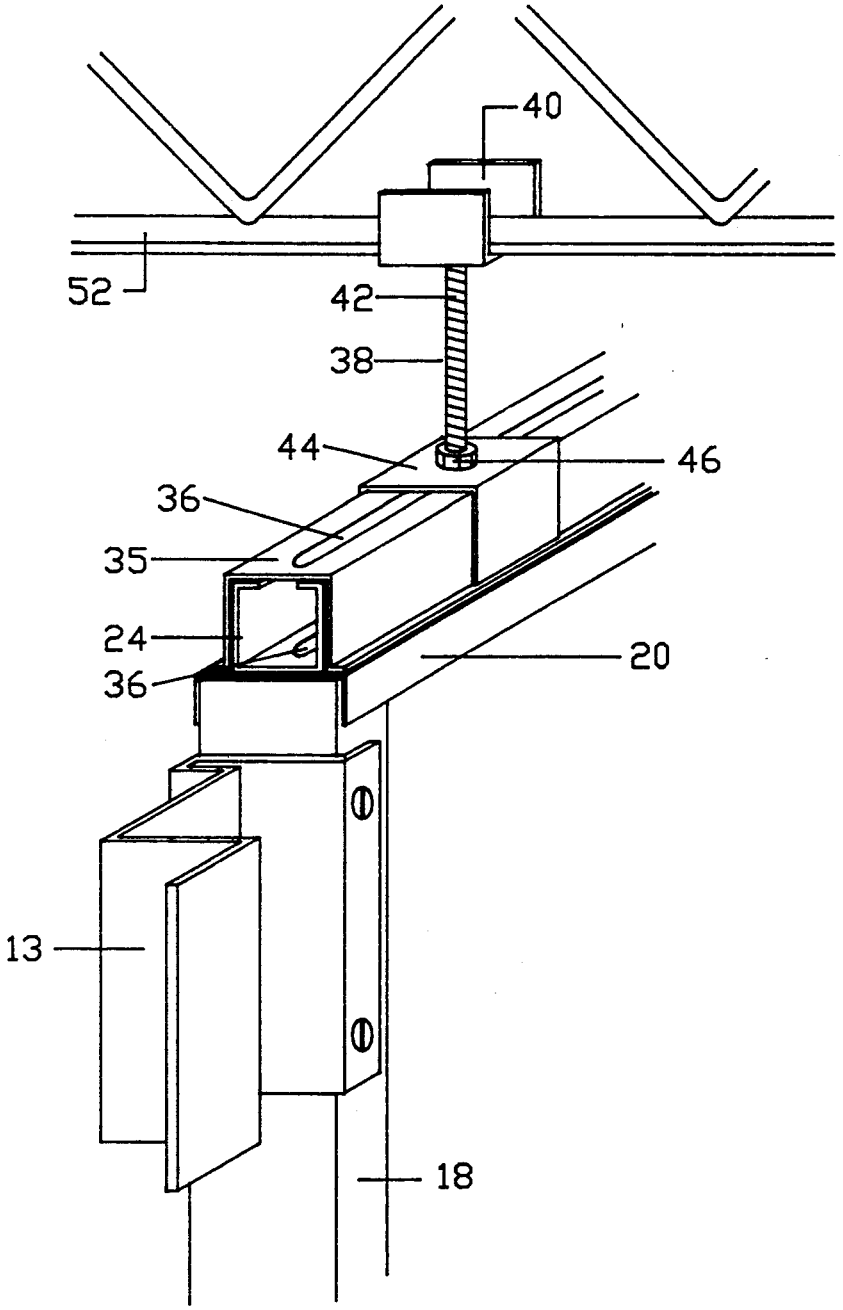
FIG. 6 is an axonometric view of the wall panel 10 and perpendicular ceiling joist.

FIG. 6 shows a typical wall panel 10 and jacking mechanism 38 with the wall panel 10 running perpendicular to ceiling joists 52. The saddle 40 of the jacking mechanism 38 straddles the joist 52.

Figure 7:
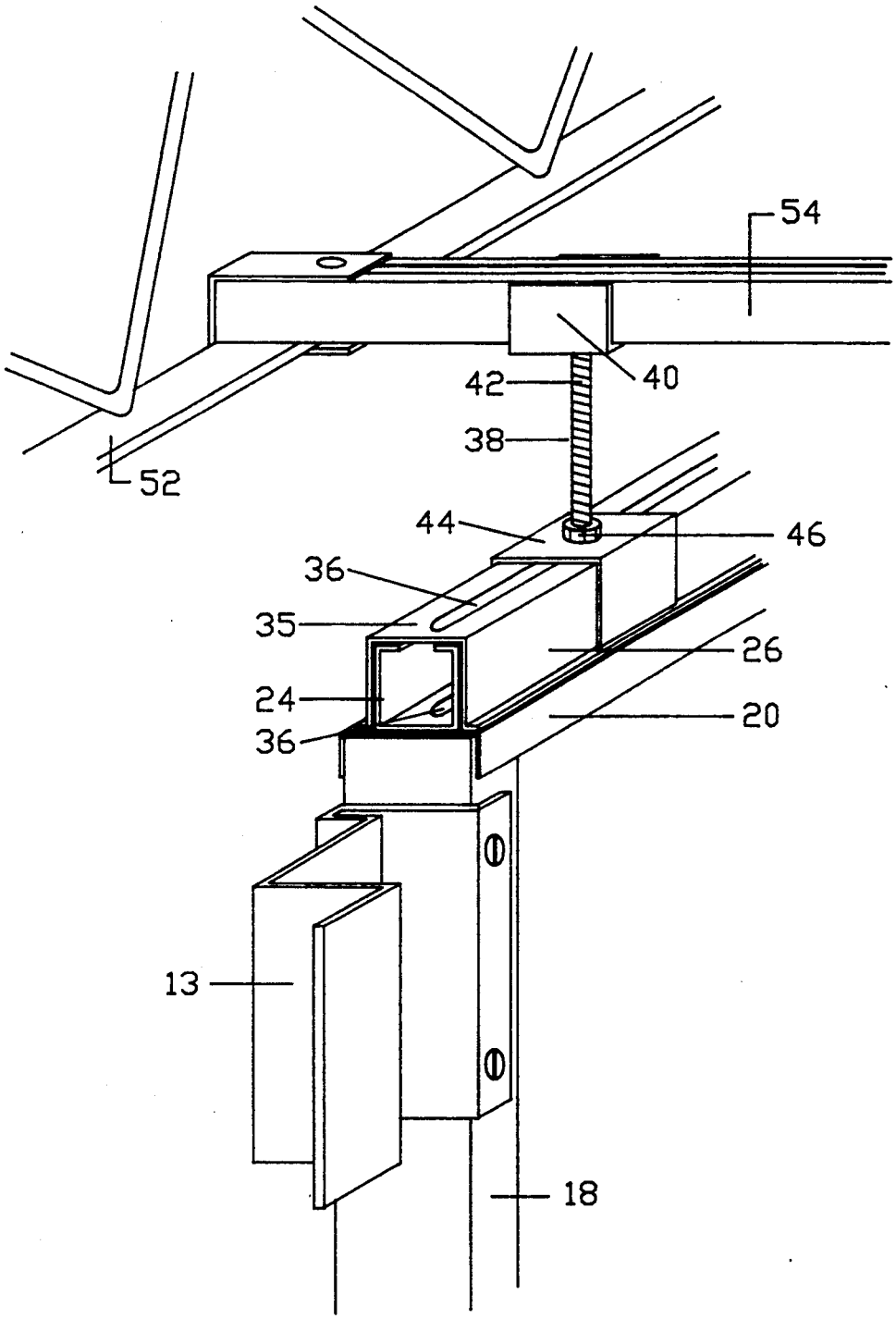
FIG. 7 is an axonometric view of the wall panel 10 and parallel ceiling joists.

FIG. 7 shows a typical wall panel 10 and jacking mechanism 38 with the wall panel 10 running parallel to rows of ceiling joists 52. An additional support beam 54 is positioned perpendicularly between the parallel joists 52 as needed for wall panel support, with a jacking mechanism 38 located so that the saddle 42 straddles the beam 54 to secure the wall panel 10 in place.

Figure 8:
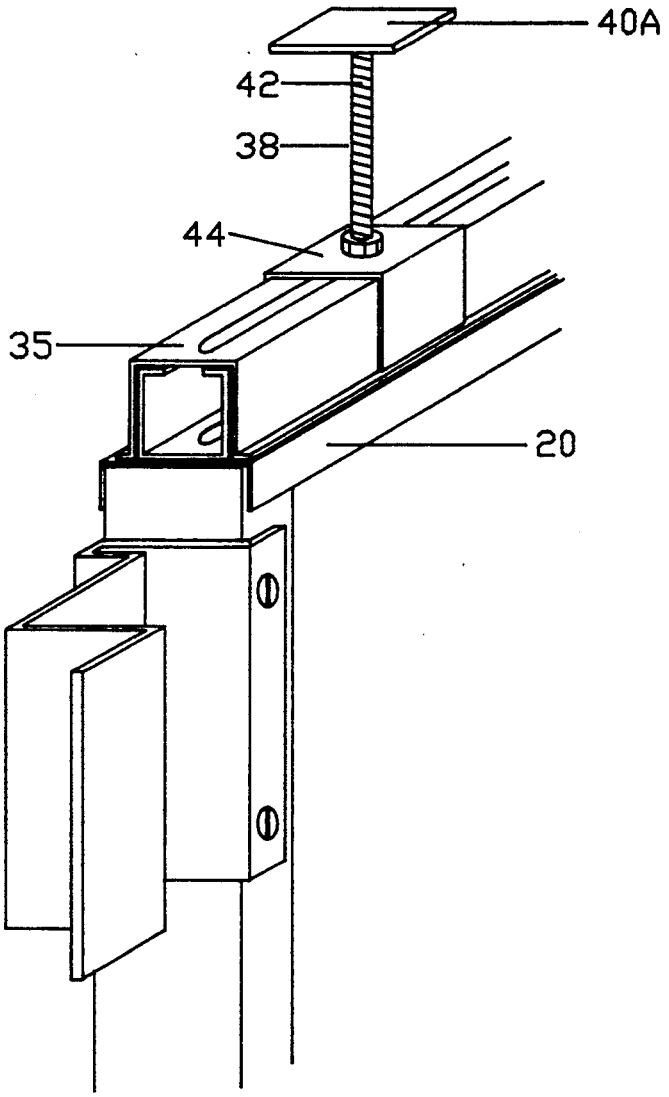
FIG. 8 is a partial axonometric view of the wall panel 10 and the mounting mechanism for use with flat ceilings.

FIG. 8 shows a jacking mechanism 38 having an upper sole plate 40A rather than a saddle 40. This jacking mechanism when equipped with sole plate 40A is used when the sole plate is to bear against a flat ceiling configuration. The lock cap washer 44 is fitted onto rod 42B and secured by the lock nut 46 as previously described for the typical jacking mechanism 38 to secure the wall panel 10 into place.

Figure 9:
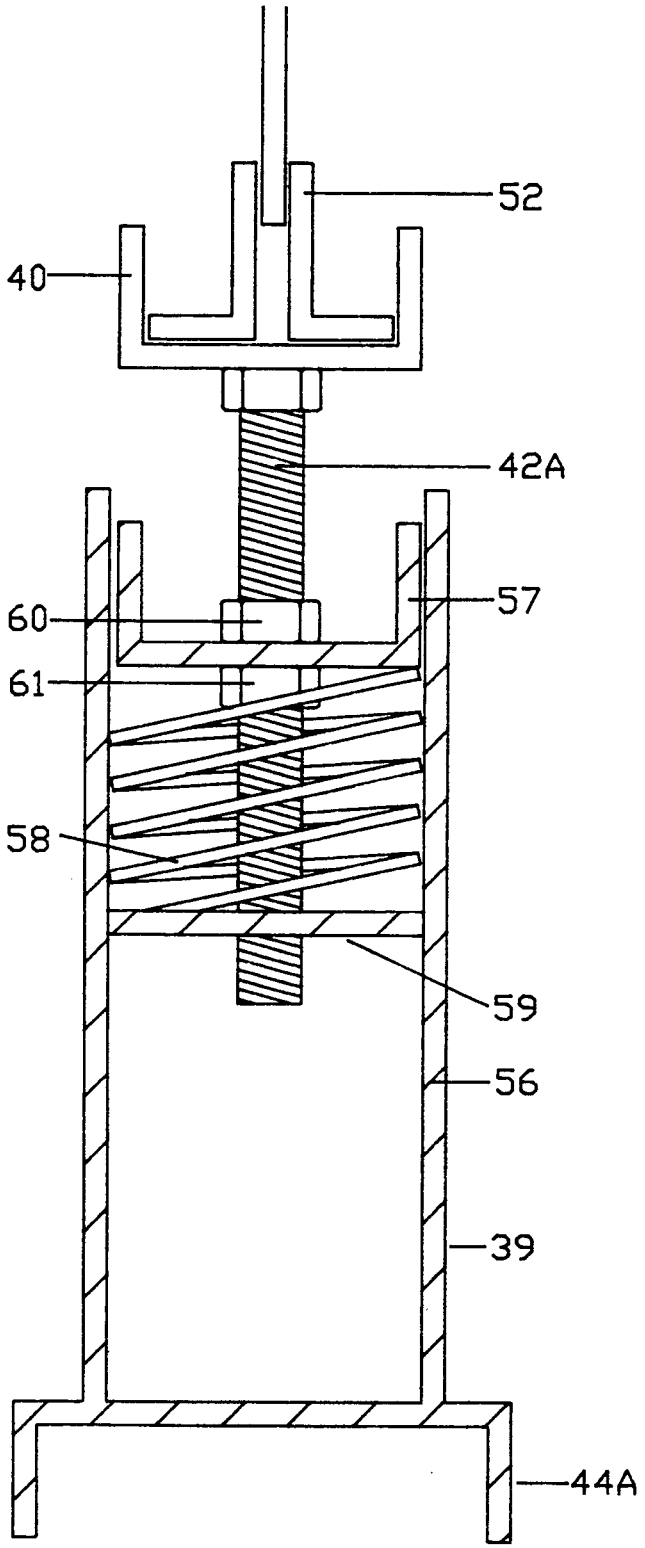
FIG. 9 is a modified mounting mechanism having a deflection spring.

In FIG. 9 shows a modified jacking mechanism designated 39 having a spring mechanism to allow for deflection and deformation of the ceiling joist 52 when it is desirable to accommodate unusual live load changes and/or creep. The threaded rod 42 of the typical jacking mechanism 38 is shown 42A. The lower portion of 42A is attached to plate 57 by bolts 60 and 61 or other means and the plate 57 is fitted within a cylinder 56 to butt against a spring 58 resting on a spring shelf 59 within the cylinder 56. The cylinder 56 is attached to a U-shaped plate 44A to saddle the wall panel 10. The spring shelf 59 has a bore to accommodate the rod 42A which served as a guide for the rod when deflection occurs.

Figure 10:
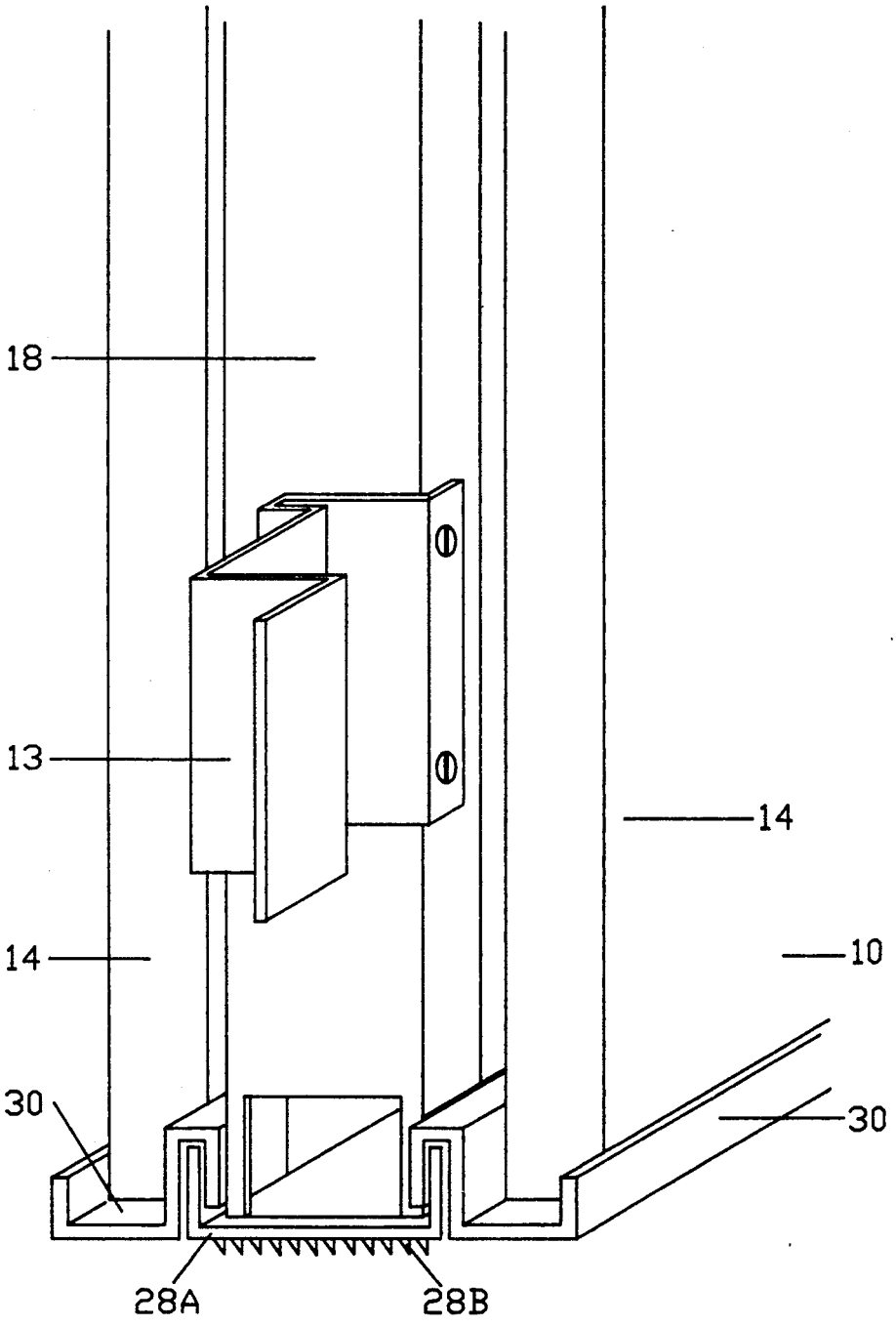
FIG. 10 is a view of the wall panel sole plate adapted for use on carpeted floors.

FIG. 10 shows an alternative floor plate 28 designated 28A for use on carpeted floors. The floor plate has a serrated lower surface 28 also known as carpet teeth to allow the carpet to remain undamaged by the wall panel 10.

Figure 11:
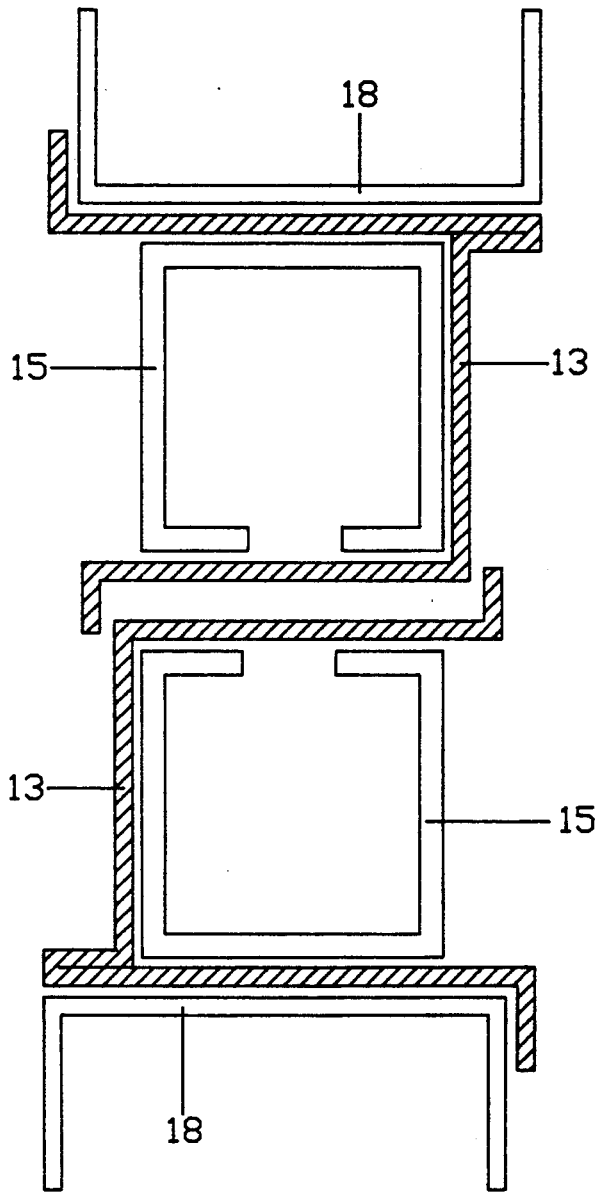
FIG. 11 shows a typical connection between adjoining wall panels 10.

FIG. 11 shows the a cross-section view of a typical connection between adjoining wall panels 10. The wall panels 10 are connected by means of the column stubs 15 and the column clips 13.

The material utilized in the typical wall frame 16 of wall panel 10 as illustrated is light gauge metal of the type typically used in metal building construction. Other types of material such as wood, steel, aluminum, plastic, graphite or other materials may be utilized in a siumilar manner to construct the wall frames 16 and the individual components.

It is thought that the apparatus for interior wall system and many of its intended advantages will be understood from the foregoing description and it will be apparent that various changes my be made in form, construction, and arrangement of the parts thereof without departing from the spirit and scope of the invention or sacrificing all of its material advantages, the form herein before described being merely illustrative of the preferred embodiment of the invention.

I claim:

1. A movable interior wall panel comprising:

(a) a frame having a plurality of horizontal members and a plurality of vertical members, said horizontal members having a longitudinal slot along the length of said horizontal members, wherein said horizontal members form a ceiling edge and a floor edge of said frame;

(b) a plurality of jacks located along said ceiling edge of said frame and a plurality of jacks located along said floor edge of said frame, said jacks having a bearing plate, a threaded shaft mounted to said bearing plate, a washer plate and a lock nut, said jacks being slidably mounted to said frame by positioning said threaded shaft through said longitudinal slot of said horizontal members; and (c) sheathing applied over said frame.

2. A movable interior wall panel for enclosing areas between a ceiling and a floor comprising:

(a) a frame;

(b) a plurality of screwably adjustable jacks for temporarily fixing said frame between said ceiling and said floor, said screwably adjustable jacks being slidably positionable along said frame between said frame and said ceiling and between said ceiling and said floor;

(c) sheathing applied over said frame.

3. A wall panel as recited in claim 2 wherein each said screwably adjustable jack includes a threaded rod, a bearing plate mounted to said rod, a washer plate and a lock nut.

4. A wall panel as recited in claim 3 wherein said bearing plate is flat.

5. A wall panel as recited in claim 3 wherein each of said jacks along said frame between said ceiling and said frame have U-shaped bearing plates.

6. A temporary interior wall system for locating and positioning interior walls between a ceiling area and a floor area comprising:

(a) a plurality of wall panels, said wall panels having a ceiling edge, a floor edge and first and second ends, said panels having a plurality of vertical members and a plurality of horizontal members said horizontal members having a longitudinal slot along the length of said members, and where said ceiling edge and said floor edge have a slotted longitudinal member and where said first end and said second end have a vertical member;

(b) a plurality of columns having ceiling ends and floor ends located at said first ends and said second ends of said panels;

(c) a U-shaped floor track running along said floor area sized to receive said floor edges of said wall panels;

(d) means for mounting said columns to said wall panel ends; and (e) a plurality of screwably engaged jacks having a threaded rod, a bearing plate, a washer plate and a lockout wherein said jacks are slidably mounted to said wall panels between said wall panels and said ceiling area by inserting said threaded rod of said jacks into said longitudinal slot of said horizontal ceiling edge member and turning said lock nut to force said washer plate against said horizontal ceiling edge member and said bearing plate against said ceiling area; and wherein one of said screwably engaged jacks is located at said ceiling end and said floor end of each of said columns so that said columns may be fixed between said ceiling area and said floor area by turning said lock nuts to force said washer plates against said column ends and said bearing plates against said ceiling area.

7. A wall panel system as recited in claim 6 wherein said ceiling area is comprised of ceiling joists and where said jack bearing plates are U-shaped saddles fitted under said joists.

8. A wall panel system as recited in claim 6 wherein said floor track is serrated for use over carpeted floors.

9. A wall panel system as recited in claim 6 wherein said jack bearing plates are flat.

10. A wall panel system as recited in claim 6 wherein said jack washer plates are U-shaped to fit over said wall panel ceiling edges and said column ceiling ends.

11. A wall panel system as recited in claim 6 wherein said jacks have a spring to allow for vertical deflection of said bearing plate.

* * * * *